US006537040B2

(12) United States Patent
Herrmann et al.

(10) Patent No.: US 6,537,040 B2
(45) Date of Patent: Mar. 25, 2003

(54) RADIAL PISTON PUMP

(75) Inventors: Michael Herrmann, Lebach (DE); Manfred Fischer, Kressbronn (DE)

(73) Assignee: ZF Batavia, L.L.C., Batavia, OH (US)

( * ) Notice: Subject to any disclaimer, the term of this patent is extended or adjusted under 35 U.S.C. 154(b) by 20 days.

(21) Appl. No.: 09/853,140

(22) Filed: May 10, 2001

(65) Prior Publication Data

US 2001/0048880 A1 Dec. 6, 2001

(30) Foreign Application Priority Data

Jun. 2, 2000 (DE) ..... 100 27 424

(51) Int. Cl.[7] ..... F04B 1/04; F04B 27/04

(52) U.S. Cl. ..... 417/273; 417/284; 417/440; 417/545; 137/512.4

(58) Field of Search ..... 417/273, 470, 417/284, 292, 307, 310, 312, 545, 546, 647, 554, 252, 440, 441, 547; 181/272, 237, 238; 137/512.4, 512.15

(56) References Cited

U.S. PATENT DOCUMENTS 4,975,025 A * 12/1990 Yamamura et al. ..... 417/273
5,482,442 A * 1/1996 Blair et al. ..... 417/220

FOREIGN PATENT DOCUMENTS

DE 43 37 144 A1 5/1995
DE 43 38 641 A1 5/1995
DE WO 99/50555 * 10/1999
JP 4-187871 A * 7/1992
JP 5-302566 A * 11/1993
JP 9-151838 * 6/1997
WO 99/24712 5/1999 ..... F04B/1/04

* cited by examiner

*Primary Examiner*—Charles G. Freay
*Assistant Examiner*—Han L. Liu
(74) *Attorney, Agent, or Firm*—Davis & Bujold, P.L.L.C.

(57) ABSTRACT

The invention is based on a radial piston pump (1) with a pump body (2), in which pump body (2) are placed pistons (4), and cylinders (5) arrayed radial to a cam (14) and the pistons (4) upon an inward thrust suck in fluid by means of suction side intakes (17) and upon an outward thrust, the pistons (4) impel fluid through pressure openings (7) in the outer end walls (6) of the cylinder (5) into a plenum (10) whereby the check valves (22) are formed from an annular coil spring valve (9) which cover the pressure ports (7) and the thereto connected stress relieving corrugations (8), and upon the exceeding of a specified threshold transport pressure, the respective pressure opening (7) opens to the plenum (10). The proposal is made, that a stress relieving zone (27) of a piston-cylinder unit (4, 5) be connected to the pressure zone (5, 7, 26) of a neighboring piston-cylinder unit (4, 5). Thereby pressure peaks in neighboring piston-cylinder units (4, 5) would be ameliorated and by a thrust of reduced magnitude of the coil spring valve (9) of a relatively great circumferential area, the intensity of noise would be diminished.

8 Claims, 2 Drawing Sheets

RADIAL PISTON PUMP

FIELD OF THE INVENTION

Figure 1:
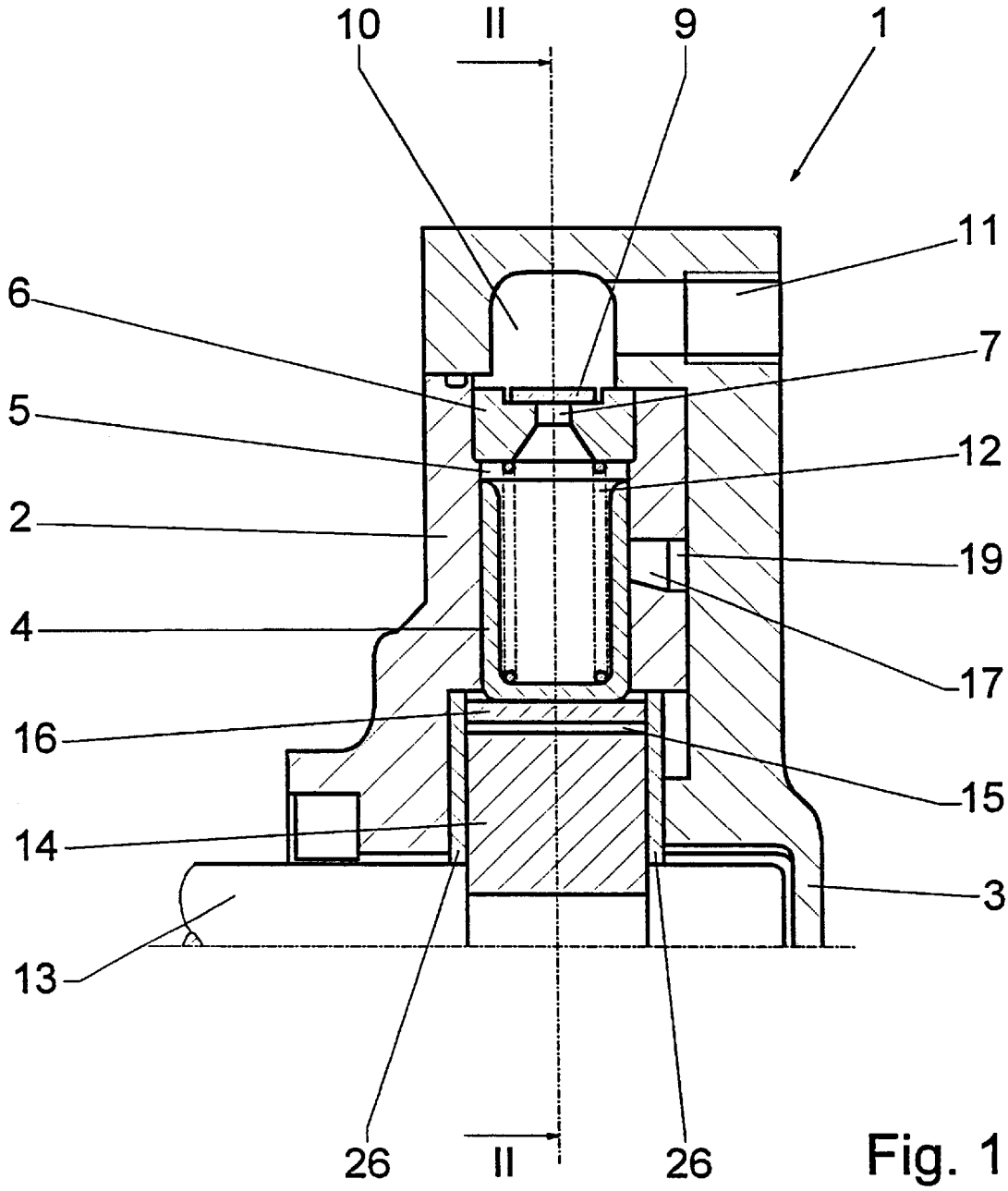

The invention concerns a radial piston pump.

BACKGROUND OF THE INVENTION

Radial piston pumps are, among other types of pumps, employed in motor vehicles, for lubrication medium pumping in internal combustion engines and transmissions. Further applications are found in pumps for hydraulic positioning members, steering joints, springs, couplings, stepless drives, automatic controlled transmissions, hydraulic driving aids, auxiliary drives, concrete mixers, and the like. These pumps characterize themselves as particularly adaptable in for installations wherein high pressures are involved.

Classified as positive displacement pumps, these transport the pressure medium, not in continuous flow, but non-uniformly in increment volumes per rotation of an eccentrically centered drive cam. The cyclically transported volumes bring about, both on the suction side as well as on the pressure side, variations in pressure, pressure oscillations, or pulsations. These pressure variances are superimposed on intake and output impulses, which, arise by the opening and closing of the transport chamber. The pulsations are especially great, if during the use of inlet or outlet valves of the coil spring type, application volumes with large pressure variations are suddenly connected. Further, intense pressure swings may occur, if the pressure in the system is high or the cylinder is only partially filled.

When the pressure in a cylinder attains such a pressure as to trigger the opening of the annular coil spring valve closure element, then this element rises from its seating in the area of the respective cylinder and the hydraulic medium, i.e. the hydraulic fluid, is forced into the plenum. If the pressure in the cylinder falls under the closure point of the coil spring valve, then the respective closure element is forced back onto said seat and thereby causes a loud hammer sound. This procedure repeats itself for each rotation of the drive cam, and as often as the number of the piston-cylinder units in the pump.

The said noise is just so much louder, the more dynamically the opening and closing process runs, that is, in accord with how great the ratio is between the pressure at opening and closing and further, in accord with the slope of the pressure increase curve from the instant of the opening. If these several values run very high, then the coil spring valve element is lifted distant from its seat very quickly and subsequently strikes accordingly hard on said seat upon its return.

DE 43 38 641 A1 makes known a radial piston pump, in which a coil spring valve lies on a seat located on the circumference of a pump body and which covers the pressure opening of the cylinder. In order to keep the threshold of the opening pressure of the said valve coil spring to a minimum, the exit sides of the pressure openings are provided with stress relieving corrugations, which run in the circumferential direction of the seating surfaces. By this means, the surfaces of the coil spring valve initially loaded by the opening pressure are increased, so that the necessary opening pressure is lessened. Further, the opening thrust remains small, since the stress relieving corrugations apportion the hydraulic fluid over nearly the entire length of the circumference, so that the excess pressure increase remains small. As a result of the small opening thrust of the coil spring valve, noise is also reduced.

DE 43 37 144 A1 discloses a radial piston pump, in which elastic rubber ring segments are placed, which are pressed against sealing surfaces proximal to the pressure opening. These surfaces, on which said segments seat, are provided with concentric corrugations, which communicate with the interior of the cylinder by means of small borings. Since the underside of the sealing segments, at the beginning of the transport thrust are not only stressed over the projected area of the pressure opening, but additionally over the projected area of the corrugations, the surface of the sealing segments is enlarged, thus acting pressure of the given opening may be kept small.

Thus, the invention has the purpose of reducing the noise level of generic type radial piston pumps.

SUMMARY OF THE INVENTION

In accordance with the invention, a stress relieving zone of a piston-cylinder unit is connected by means of a conduit to the pressure zone of a neighboring piston-cylinder unit. This arrangement achieves the goal, that the pressure between two neighboring piston-cylinder units can be equalized, so that pressure peaks are ameliorated. Further, the pressure in a piston-cylinder unit already in transport thrust supports the opening pressure in the neighboring piston-cylinder lagging in its transport thrust. By this means, the coil spring valve in the area of a pressure opening is peremptorily controlled by the higher pressure of the neighboring, preceding piston-cylinder unit. The result of this is that the coil spring valve is lifted with a lesser thrust, over a relatively greater circumferential zone, between two coacting piston-cylinders.

The conduit between the relief zone and the pressure area of a neighboring piston-cylinder unit can be constructed in a very simple manner in a radial piston pump with an even number of piston-cylinder units, in that their stress relieving corrugations can be constructed in pairs with one another. By the connection of the piston-cylinder units with the stress relieving corrugations, the pressure curve in the cylinders is smoothed out. Further, the coil spring valve elements between the two connected piston-cylinder units are already lifted, as soon as the first piston-cylinder unit reaches the opening pressure threshold, and remains open until pressure drops below the closure pressure of the second piston-cylinder unit.

In this way, not only the small thrust of the coil spring valve, but also the cutting in half of the number of the opening incidents, substantially reduces the noise.

A variant exists, in that the conduit is formed by a boring, which runs from one cylinder to a stress relieving zone of the neighboring piston-cylinder unit which lags behind in the direction of rotation. In this way, hydraulic fluid from the piston-cylinder unit which precedes in the transport thrust, is fed to the stress relieving zone, especially to the stress relieving corrugations of a piston-cylinder unit, which lags in the transport thrust.

In this way a smoothing of the curves in the cylinders which are bound together occurs, and the opening pressure of coil spring valve will be reached earlier, so that a more uniform transport exists and pressure variations of a high order are prevented. Radial piston pumps with eight piston-cylinder units and with stress relieving corrugations that are connected to one another in pairs, possess on this account still a pressure oscillation of the fourth power.

In order to improve the intake by suction of cold, high viscosity oil, it is of advantage, to place in each boring, a check valve. This so acts, that during the intake operations, the suction in the cylinder is improved, and in spite of it being during the transport thrust, the neighboring piston-cylinder unit is supplied with hydraulic fluid.

Instead of, or in addition to, the check valve, a temperature sensitive orifice can be provided in the boring, which reduces the cross section of the boring at low temperatures, or, in an extreme case, can close the opening. The orifice can also be designed as a control valve, which is controlled in relation to additional directive parameters from an electronic control unit.

Similar effects can be achieved by an annular suction groove, which connect the suction openings with each other. In this case, however, one has to tolerate overlapping of the control times of the currently connected cylinders, which, when taken as a whole, result in a somewhat reduced pump delivery. In order to compensate for this effect, the suction openings of the cylinder can be designed alternately larger and smaller about the circumference. By means of the connection of two cylinders, then the possibility exists, that during the suction thrust of a first cylinder having a larger suction opening, support is acquired from a greater suction from a second cylinder connected to it, whereby the first cylinder fills better, thus compensating for an otherwise occurring loss.

BRIEF DESCRIPTION OF THE DRAWING(S)

Further advantages are made evident in the following description based on drawings. In the drawings, embodiment examples of the invention are presented. The description and the claims contain numerous features in combination.

Figure 2:
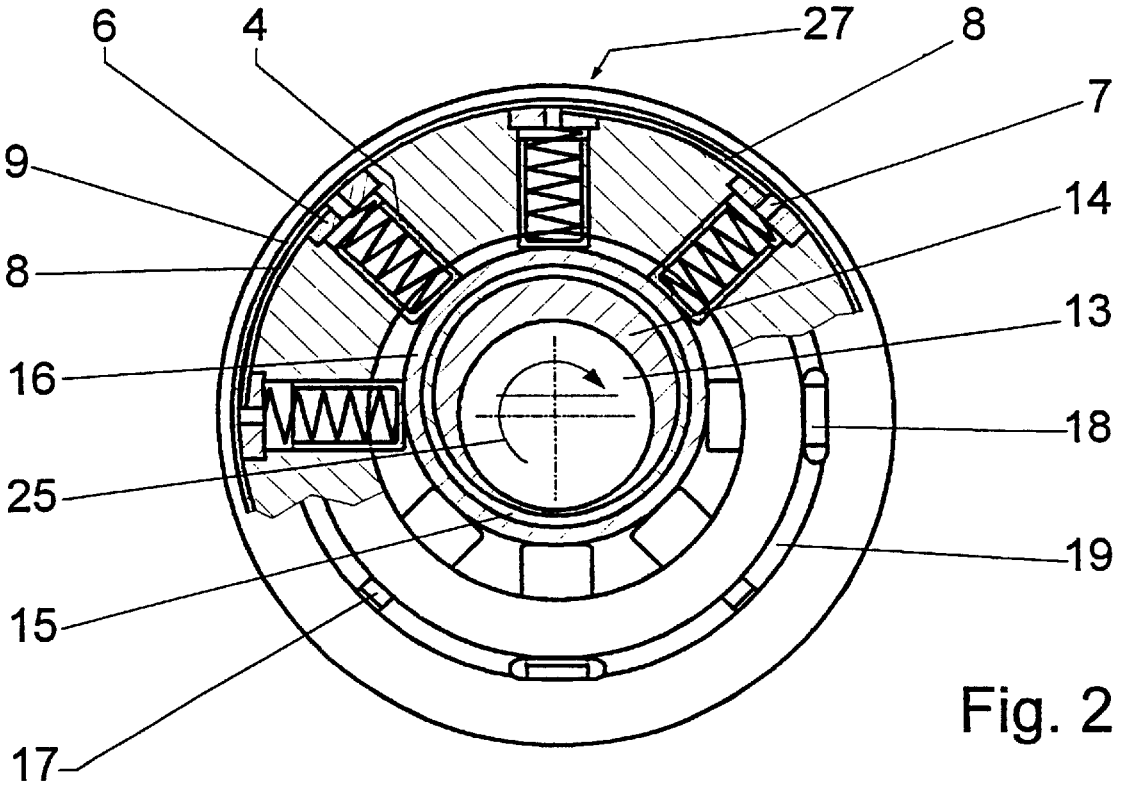
Figure 3:
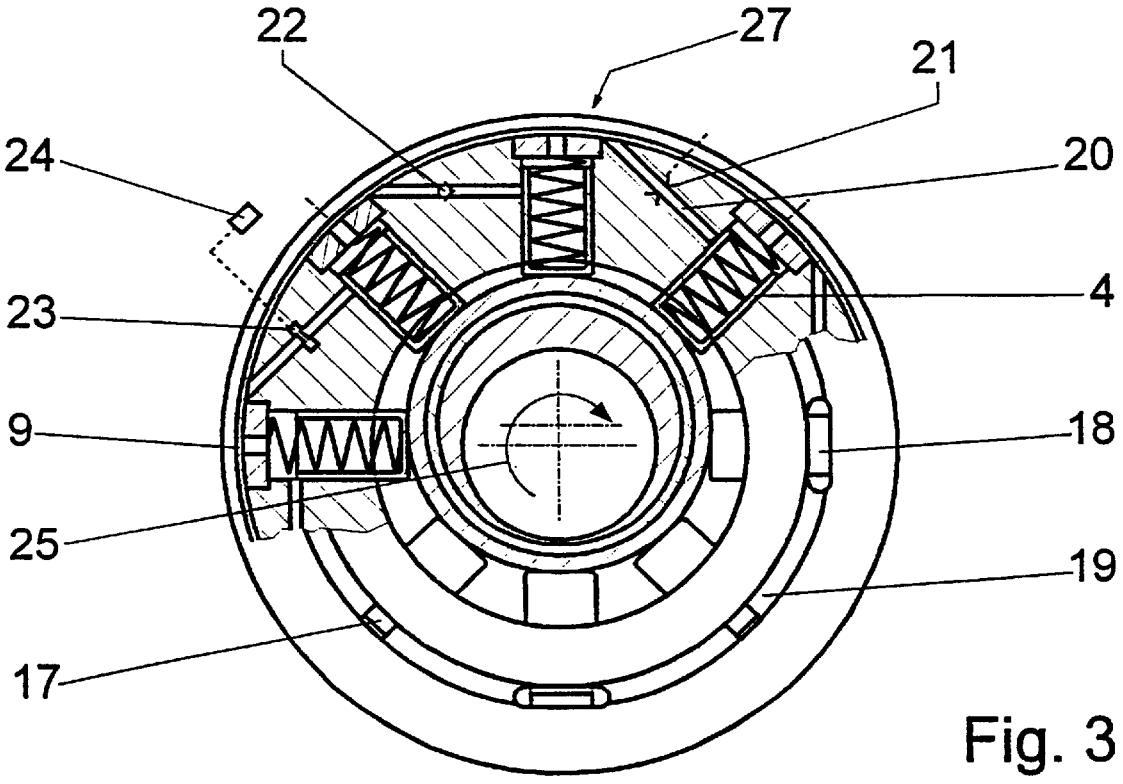

The expert in the field will observe features individually from a practical standpoint and then combine them in sensible further combinations. There is shown in:

FIG. 1 the upper half of a longitudinal section of a radial piston pump in accord with the invention, FIG. 2 a section corresponding to the section line II—II of FIG. 1, and FIG. 3 a variant of FIG. 2.

The radial piston pump 1 possesses a pump housing 3, into which a pump body 2 has been inserted and sealed. Pistons 4 and cylinders 5 form piston-cylinder units which are radially arrayed in the pump body 2. The pistons 4 reciprocate by a driven eccentric cam 14, which is affixed to the drive shaft 13 or possibly formed thereon. The cam 14, which is guided in the pump housing 3 between two axial guard disks 26, is encompassed by a damping ring 15, upon which a bearing shell 16 is seated. These bearing shells 16 are comprised of an appropriate raw material, which assures a minimum of abrasion and a maximum of operational life. The damping ring 15, which can be in the form of an annular bellows-like spring, damps the pressure oscillations acting on the piston 4.

The cylinder 5 is closed in the direction of the circumference of the pump body 2 by a plug 6, which is inserted in the pump body 2 and possesses a pressure port 7, which allows the cylinder 5 to communicate with a plenum 10 in the pump housing 3.

Leading from the plenum 10 is a connection fitting 11 for an outlet to equipment (not shown) using the hydraulic fluid under pressure. The internal pressure port 7 is capped by a coiled annular valve spring 9, which lies upon a seat of the plug 6, and in accord with the particular pressure relationships, closes or opens the flow through pressure port 7.

The pistons 4 execute respectively both an outward and an inward thrust during one revolution of the cam 14, which turns in the direction of rotation 25.

As this takes place, the affected pistons 4 are pressed sequentially against the bearing shell 16 by piston spring 12. Upon the outward thrust, a respective piston 4 closes off the suction side intake port 17 with its end rim. As the said suction side intake port 17 is closed off and the check valve 22 shuts, the filling cycle of the cylinder 5 is ended. Now the pressure in the cylinder 5 rises to such a level that a pressure threshold is reached at which the annular, coiled, valve spring 9 is lifted from its seat in the respective area and the pressure opening 7 of the respective piston opens, so that hydraulic fluid from the cylinder 5 can be forced into the plenum 10.

In order to lift the annular, coiled, valve spring 9, the pressure against the opening multiplied by its effective area must overcome the system pressure in the plenum 10 multiplied by its effective area plus the resident force of said annular, coiled valve spring 9. During the period of the closed pressure port 7, the active area diminishes itself to the cross sectional area of said port 7 and possibly to the circumferential areas of bordering, relieving undulations 8. Because the active area quickly increases itself upon the raising of the annular, coiled, valve spring 9, the cylinder side active areas quickly equalize those active areas of the plenum side, whereby the pressure port 7 once again closes against a substantially reduced closure pressure.

In order to slow the dynamics of the opening procedure, in accord with the invention, the opening time of the coil spring valve 9 is extended by a smaller thrust for the reason that hydraulic fluid is diverted from one of the piston-cylinder units 4, 5 which is preceding in the transport through a conduit in a common stress relieving corrugation 8 or through a boring 20 leading to a stress relief zone 27 of a lagging piston-cylinder unit 4,5. The higher pressure of the piston-cylinder unit lifts the coil spring valve 9 in the area of the lagging piston-cylinder unit 4, 5, so that, upon reaching the lower closure pressure threshold, in the lagging piston-cylinder unit 4, 5, the pressure opening 7 can be held open. Simultaneously, by means of the connection conduits 8,20, pressure peaks and pulsations are smoothed out.

In the embodiment shown in FIG. 2, an even number of piston-cylinder units 5, 4 are provided, namely in this-case, the number is eight. Of these eight, two neighboring piston-cylinder units 4, 5 are connectedly paired by a common stress relief corrugation 8.

By means of said stress relieving corrugation 8, a further achievement is that the coil spring valve 9 serving the piston-cylinder units 4, 5, which are connected together, need be raised only once and correspondingly, reseats only once, so that the number of the closure noise incidents per revolution of the cam 14 is reduced by half, and accordingly, the intensity of noise because of the reduced thrusts of the coil spring valve 9 is likewise reduced.

In the case of the embodiment shown in FIG. 3, the borings 20 so act, that the coil spring valve 9 is continually lifted from its seat and continually returns thereto, so that no striking noises arise. Further, by means of said boring 20, pressure peaks in the cylinders 5 are diminished. In order to improve a cold start at low ambient temperatures, check valves 22 are provided in the borings 20, which close access to the piston-cylinder units 4, 5, which precede in the transport phase.

Instead of the check valve 22, also a controllable restrictive orifice 21 or a regulating valve 23 can be provided. These may regulated by an electronic control unit 24 and be dependent upon temperature or upon appropriate regulating parameters. The restrictive orifice or the regulating valve 23 throttle the through-flow cross-section of the boring, or can close it upon low temperature of the hydraulic fluid. By this the achievement attained is that upon the inward thrust of the respective piston 4, a sufficient suction is developed, in order to draw in the hydraulic fluid, which, at low temperatures exhibits a higher viscosity.

In order to smooth out pressure peaks between neighboring piston-cylinder units 4, 5, it can further be advantageous to connect the suction intakes 17, 18 by a common annular conduit 19 whereby the suction openings are so dimensioned, that operational overlaps arise between two neighboring suction openings 17, 18 during the open periods. In order compensate, at least partially, for the losses caused by said overlappings, the suction intakes 17, 18 possess, in direction of rotation 25, alternately a greater and a smaller effective opening. By means of the greater suction opening and because of the interconnection of two cylinders 5, during the suction intake thrust of a first cylinder 5, (which has the larger suction opening 18) there is created an increased suction in first cylinder 5, since the suction is reinforced by the second cylinder 5 with the smaller suction opening 17. The improved filling of the cylinder 5 with the larger suction opening, substantially compensates for the otherwise occurring losses in quantities transported.

What is claimed is:

1. A radial piston pump (1) having a pump body (2) in which pistons (4) and cylinders (5) are in a radial array with the pistons operated by a cam (14) wherein the pistons (4), upon a radially inward movement into the cylinders (5) suck a fluid through inlets (17, 18) and upon a radially outward movement convey said fluid by way of check valves (22) into plenums (10) trough pressure ports (7) in outer end walls (6) of the cylinders (5), wherein the check valves (22) comprise an annular spring valve (9) which covers pressure ports (7) and has stress relieving conduits (8) which are connected to said pressure ports (7) whereby upon exceeding a specified threshold transport pressure, the spring valve (9) releases a respective pressure port (7) to the plenum (10), and wherein a stress relieving zone (27) of a piston-cylinder unit (4, 5) is connected by a conduit (8, 20) with a pressure zone (5, 7, 27) of a neighboring piston-cylinder unit (4, 5).

2. The radial piston pump (1) in accordance with claim 1, wherein an even number of piston-cylinder units (4, 5) are provided, the stress relieving conduits (8) of which are connected together in paired fashion.

3. The radial piston pump (1) in accordance with claim 2, wherein the inlets (17, 18) are connected together by an annular conduit (19) and the inlets (17, 18) exhibit alternating larger, smaller cross-sectional effective areas.

4. The radial piston pump (1) in accordance with claim 1, wherein a bore (20) from one cylinder (5) leads to a stress relieving zone (27) of a neighboring, piston-cylinder unit (4, 5) which lags in Vie direction of rotation (25).

5. The radial piston pump (1) in accordance with claim 4, wherein the bore (20) includes a controllable restrictive orifice (21).

6. The radial piston pump (1) in accordance with claim 5, wherein the restrictive orifice (21) is controllable to block the through flow through the bore (20).

7. The radial piston pump (1) in accordance with claim 5, wherein the restrictive orifice (21) is regulated in accord with temperature to reduce a cross section of the boring (20) at low temperature.

8. The radial piston pump (1) in accordance with claim 4, wherein a check valve (22) is placed in the bore (20) and is closed in a direction toward the cylinder (5).

* * * * *